US005702856A

United States Patent [19]

Mashimo et al.

[11] Patent Number: 5,702,856

[45] Date of Patent: Dec. 30, 1997

[54] METHOD FOR MAKING AN IMAGE AND A PHOTOSENSITIVE BODY FOR LIQUID DEVELOPMENT

[75] Inventors: Kiyokazu Mashimo; Fumio Ojima; Toru Ishii; Katsumi Nukada, all of Minami-Ashigara, Japan

[73] Assignee: Fuji Xerox Co, Ltd., Tokyo, Japan

[21] Appl. No.: 727,313

[22] Filed: Oct. 8, 1996

[30] Foreign Application Priority Data

Oct. 11, 1995 [JP] Japan ..... 7-263059

[51] Int. Cl.[6] ..... G03G 13/10; G03G 5/087

[52] U.S. Cl. ..... 430/96; 430/117

[58] Field of Search ..... 430/59, 76, 96, 430/117

[56] References Cited

U.S. PATENT DOCUMENTS

| | | | |
|---|---|---|---|
| 4,801,517 | 1/1989 | Frechet et al. | 430/59 |
| 4,806,443 | 2/1989 | Yanus et al. | 430/56 |
| 4,806,444 | 2/1989 | Yanus et al. | 430/56 |
| 4,937,165 | 6/1990 | Ong et al. | 430/59 |
| 4,959,288 | 9/1990 | Ong et al. | 430/59 |
| 4,983,482 | 1/1991 | Ong et al. | 430/59 |
| 5,034,296 | 7/1991 | Ong et al. | 430/59 |
| 5,604,064 | 2/1997 | Nukada et al. | 430/59 |

FOREIGN PATENT DOCUMENTS

| | | |
|---|---|---|
| 58-102946 | 6/1983 | Japan . |
| 58-102947 | 6/1983 | Japan . |
| 2-59-28903 | 7/1984 | Japan . |
| 61-20953 | 1/1986 | Japan . |
| 1-134456 | 5/1989 | Japan . |
| 1-134457 | 5/1989 | Japan . |
| 4-133065 | 5/1992 | Japan . |
| 4-133066 | 5/1992 | Japan . |

*Primary Examiner*—John Goodrow
*Attorney, Agent, or Firm*—Oliff & Berridge, P.L.C.

[57] ABSTRACT

In a method for making an image comprising the steps of forming an electrostatic image on a photosensitive body having a photosensitive layer and forming a visible image by means of a liquid development utilizing a developing liquid for electrostatic charge, the photosensitive layer comprises, as an electric charge transporting material, an electric charge transporting polymeric compound which contains as a partial moiety of repeating units the structures represented by the following general formulas 1-1 and/or 1-2, (I-1)

(I-2)

where $R_1$–$R_4$ are each independently hydrogen, an alkyl radical that may have a substituent, or the like, X is a substituted or unsubstituted divalent aryl radical, k and l are each an integer of 0 or 1, and T is a divalent hydrocarbon radical of 1–10 carbon atoms that may be branched.

20 Claims, 4 Drawing Sheets

METHOD FOR MAKING AN IMAGE AND A PHOTOSENSITIVE BODY FOR LIQUID DEVELOPMENT

CROSS-REFERENCE TO RELATED APPLICATIONS

This application is a continuation-in-part of application Ser. No. 461,432 filed Jun. 5, 1995, now issued as U.S. Pat. No. 5,604,064.

BACKGROUND OF THE INVENTION

1. Field of the Invention

The present invention relates to a method for making an image, comprising developing an electrophotographic photosensitive body which contains an electric charge transporting polymeric compound, by use of an electrostatic charge developing liquid which comprises toner particles, an electrical insulating liquid and an electric charge adjusting agent; and a photosensitive body for liquid development.

2. Description of Related Art

Recently, because of advantages of high speed and high-quality print, electrophotography has been very widely used in such applications as copying machines, laser beam printers and facsimile. As electrophotographic photosensitive bodies, which are used in the electrophotography, there are hitherto well known inorganic photoelectric conductive materials such as selenium, selenium-tellurium alloys, selenium-arsenic alloys and cadmium sulfide.

Meanwhile, studies of electrophotographic photosensitive bodies utilizing organic, photoelectric conductive materials, which are less expensive and more advantageous in terms of waste disposal than electrophotographic photosensitive bodies utilizing the above-mentioned inorganic, photoconductive materials, have become active. Particularly, organic, laminate photosensitive bodies, which are based on separate functions and composed of an electric charge generating layer for generating electric charge as a result of exposure and an electric charge transporting layer, are excellent in such electrophotographic properties as sensitivity, electrostatic charge bearing property and repetition stability. Therefore, a number of proposals have been made which have been put into practice.

As for single-layer organic photosensitive bodies, there still remains room for study because they have the disadvantage that their electric properties are inferior to those of laminate photosensitive bodies, although they have advantages in terms of productivity and production costs, in addition to a system-relating advantage (i.e., positive electrification causing reduction in the emission of ozone and uniform electric charge).

Known as electrophotographic developers for developing a latent image formed on the above-mentioned photosensitive body, are dry powder developers, which are generally widely used; and liquid developers, in which toner particles are dispersed in a liquid. Recently, in response to demand for color and high-quality image, the liquid developers, by which toners of finer sizes can be used, have been attracting attentions.

However, an electrophotographic photosensitive body hitherto proposed, which has an electric charge transporting layer made by molecular-dispersing a conventional electric charge transporting material in a binder resin, is not suitable for the liquid development because it causes such problems as dissolving out of the electric charge transporting material, cracking of the binder resin due to swelling, reduction in mechanical strength, and lowering of electrophotographic properties; therefore, its usefulness as a photosensitive body is lost at an initial stage.

On the other hand, electric charge transporting polymeric materials have a potential that they may markedly overcome the above-mentioned problems, and accordingly they are actively studied now. For example, U.S. Pat. No. 4,806,443 discloses a polycarbonate made by polymerization of a specific dihydroxyaryl amine and bischloroformate, and U.S. Pat. No. 4,806,444 discloses a polycarbonate made by polymerization of a specific dihydroxy arylamine and phosgene. U.S. Pat. No. 4,801,517 discloses a polycarbonate made by polymerization of bishydroxyalkylaryl amine and bischloroformate or phosgene, and U.S. Pat. Nos. 4,937,165 and 4,959,288 disclose a polycarbonate made by polymerization of a specific dihydroxyaryl amine or bishydroxyalkylaryl amine; or a polyester by polymerization of a bisacylhalide. U.S. Pat. No. 5,034,296 discloses a polycarbonate or a polyester of an aryl amine having a specific fluorene skeleton, and U.S. Pat. No. 4,983,482 discloses a polyurethane. Japanese Patent Application Publication (JP-B) No. 59-28,903 discloses a polyester having a specific bisstyryl bisaryl amine as a main chain. Japanese Patent Application Laid-Open (JP-A) Nos. 61-20,953, 1-134,456, 1-134,457, 4-133,065, 4-133,066 propose polymers which include as a pendant in the main chain of bisstyryl bisaryl amine such an electric charge transporting substituent as hydrazone and triaryl amine, as well as photosensitive bodies utilizing the foregoing polymers.

In addition, Japanese Patent Application Laid-Open (JP-A) Nos. 58-102,946 and 58-102,947 propose a polyester obtained from a dicarboxylic acid and 2-methoxy-9,10-anthracene diol as an electric charge transporting polymeric compound.

The combination of an electric charge transporting polymeric compound which has been hitherto proposed, as a photosensitive layer and a liquid developer produces good properties at an initial stage of use. However, in a long stage of use, none of such combinations provide satisfactory results. That is, during repeated use of the photosensitive layer based on the above-mentioned electric charge transporting polymeric compounds in contact with a liquid developer in a copying machine, in the photosensitive layer localized dissolving out and eventually cracks are generated, which leads to further problems such as defects in image quality and wear of the surface of the photosensitive layer. As a result, the thickness of the photosensitive layer changes to lower its electrostatic potential thus accompanied by the change of sensitivity, thereby causing such defects as fog in the copy and decrease in the density of copy. Further problems occur, such as image defects due to surface wear damage of the photosensitive body and toner filming.

SUMMARY OF THE INVENTION

The object of the present invention is to provide a method for making an image by utilizing a photosensitive body for electrophotography which hardly causes such problems as image defects due to crack formation and defects due to wear of the surface of the photosensitive layer even in repeated use of a liquid developer for a long period of time. Another object of the present invention is to provide such a photosensitive body for electrophotography.

The present inventors have carried out repeated studies on materials of a photosensitive layer to achieve the above-mentioned objects, and as a result they have accomplished the invention based on the discovery that the use of a specific material enables the enhancement of electrical properties and quality of image in repeated use of a liquid developer that comes into contact with the aforementioned material for a long period of time.

That is, the first aspect of the present invention is a method for making an image comprising the steps of providing an electric charge to a photosensitive body for electrophotography which has a photosensitive layer on an electroconductive support, forming an electrostatic image on the photosensitive body and forming a visible image by means of a liquid development utilizing a liquid developer for an electrostatic charge latent image, which developer comprises at least toner particles, made by dispersing a dye or a pigment in a binder resin, an electrically insulating liquid and an electric charge adjusting agent, wherein the photosensitive layer contains an electric charge transporting polymeric compound which contains as a partial moiety of repeating units at least one of the structures represented by the following general formulas 1-1 and 1-2.

(I-1)

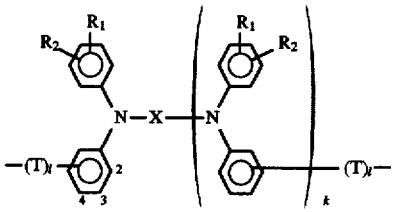

(I-2)

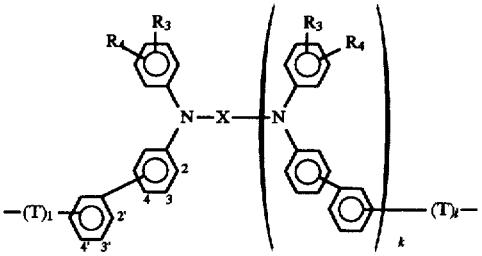

where $R_1$–$R_4$ are each independently selected from the group consisting of hydrogen, an alkyl radical that may have a substituent, an alkoxy radical that may have a substituent, a substituted amino radical, halogen and a substituted or unsubstituted aryl radical, X is a substituted or unsubstituted divalent aryl radical, k and l are each an integer selected from 0 and 1, and T is a divalent hydrocarbon radical of 1–10 carbon atoms that may be branched.

The second aspect of the present invention is a photosensitive body for liquid development that is utilized for forming an electrostatic image in a method for making an image comprising the steps of forming the electrostatic image and forming a visible image by means of the liquid development utilizing a liquid developer for an electrostatic charge latent image, which liquid developer comprises at least toner particles that are made by dispersing a dye or a pigment in a binder resin, an electrically insulating liquid and an electric charge adjusting agent, the photosensitive body comprising as an electric charge transporting material an electric charge transporting polymeric compound that contains as a partial moiety of repeating units at least one of the structures represented by the following general formulas 1-1 and 1-2, (I-1)

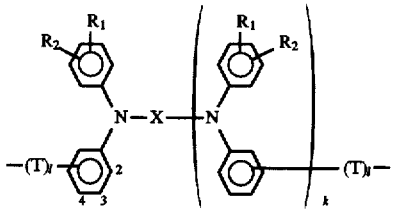

(I-2)

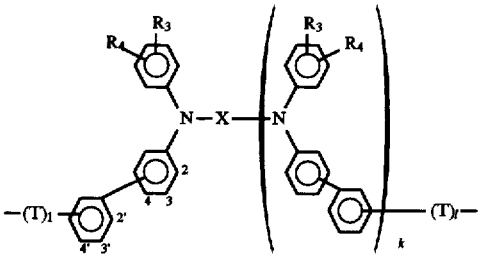

where $R_1$–$R_4$ are each independently selected from the group consisting of hydrogen, an alkyl radical that may have a substituent, an alkoxy radical that may have a substituent, a substituted amino radical, halogen and a substituted or unsubstituted aryl radical, X is a substituted or unsubstituted divalent aryl radical, k and l are each an integer of 0 or 1, and T is a divalent hydrocarbon radical of 1–10 carbon atoms that may be branched.

According to the present invention, the defect of image due to cracking in the photosensitive layer hardly occurs. In addition, since the photosensitive layer exhibits excellent resistance to wear, corona discharge and toner filming, no problem occurs in the photosensitive body; therefore, electrophotographic properties do not decrease even in the use for a long period of time. As a result, even after repeated use of the photosensitive body in a copying machine or a printer, the method for making an image according to the present invention allows to maintain the excellent stability and a high-level printability, thereby enabling to provide a copy image of excellent quality.

DESCRIPTION OF THE PREFERRED EMBODIMENTS OF THE INVENTION

Figure 1:
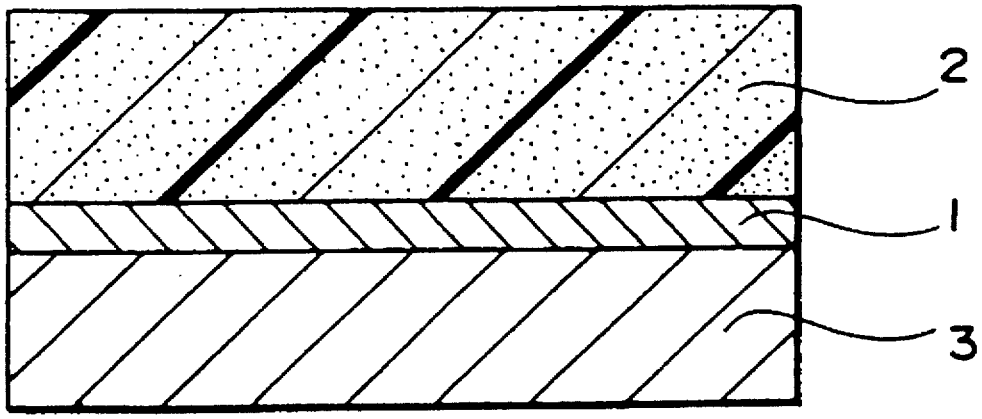
FIG. 1 is a schematically illustrated cross-sectional view of one example of the photosensitive body of the present invention.

The present invention will be explained in detail below.

In the chemical structure represented by (I-1) or (I-2) as a moiety structure of the electric charge transporting polymeric compound to be used in the present invention, preferably $R_1$–$R_4$, which are defined hereinbefore, are an alkyl radical of 1–40 carbon atoms which may have a substituent. The substituent may be any one selected, for example, from aryl, alkoxy, acid, amido, halogen and the like.

Specific examples of X in the aforementioned general formula (I-1) or (I-2) are the groups (1)–(7).

(1)

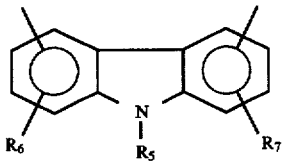

(2)

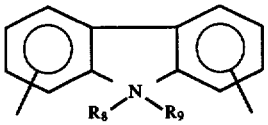

(3)

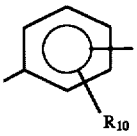

(4)

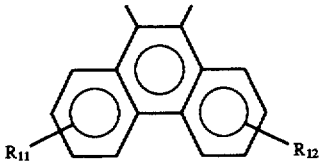

(5)

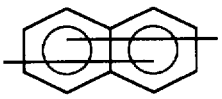

(6)

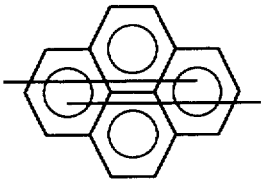

where $R_5$ is selected from the group consisting of hydrogen, an alkyl radical of 1–4 carbon atoms, a substituted or unsubstituted phenyl radical and a substituted or unsubstituted araklyl radical. $R_6$–$R_{12}$ are each independently selected from the group consisting of hydrogen, an alkyl radical of 1–4 carbon atoms, an alkoxy radical of 1–4 carbon atoms, a substituted or unsubstituted phenyl radical, a substituted or unsubstituted araklyl radical and halogen. Ar represents the following group (8), V is selected from the group consisting of the following groups (9)–(18) and a is 0 or 1

(8)

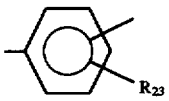

where $R_{23}$ is selected from the group consisting of hydrogen, an alkyl radical of 1–4 carbon atoms, an alkoxy radical of 1–4 carbon atoms, a substituted or unsubstituted phenyl radical, a substituted or unsubstituted araklyl radical and halogen.

$$+CH_2)_b- \quad (9)$$

$$-C(CH_3)_2- \quad (10)$$

$$-O- \quad (11)$$

$$-S- \quad (12)$$

(13)

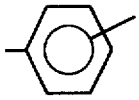

(14)

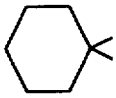

$$-C(CF_3)_2- \quad (15)$$

$$-Si(CF_3)_2- \quad (16)$$

$$-CH=CH- \quad (17)$$

(18)

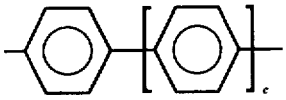

where b is an integer of 1–10 and c is an integer of 1–4.

Among the above-described polymeric compounds, particularly the polymers in which X has a biphenyl structure that is represented by the following structural formula (VI) or (VII), have a high mobility and practicability as reported in "The Sixth International Congress on Advances in Non-impact Printing Technologies. 306, 1990".

(VI)

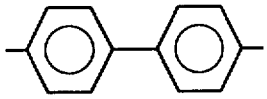

(VII)

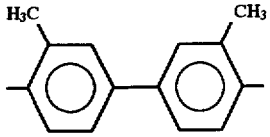

In the aforementioned general formula (I-1) or (I-2), T represents, as described hereinbefore, a divalent hydrocarbon radical of 1–10 carbon atoms that may be branched. Specific structural examples thereof are given below. In these structures, for example, T-2r means the structure which has the tetra-aryl benzidine skeleton linked to the right side of T-2 structure and T-21 means the structure which has the tetra-aryl benzidine skeleton linked to the left side of T-2 (see Tables 1–6).

$$-CH_2- \quad (T\text{-}1)$$

$$+CH_2)_2- \quad (T\text{-}2)$$

$$\begin{array}{l} CH_3 \\ | \\ -CH- \end{array} \quad (T\text{-}3)$$

$$+CH_2)_3- \quad (T\text{-}4)$$

$$\begin{array}{l} CH_3 \\ | \\ -CH-CH_2- \end{array} \quad (T\text{-}5)$$

-continued (T-6) $-C(CH_3)_2-(CH_2)_4-$ (T-7) $-CH(CH_3)-CH(CH_3)-$ (T-8) $-C(CH_3)_2-CH_2-$ (T-9) $-CH(CH_3)-(CH_2)_2-$ (T-10) $-CH_2-CH(CH_3)-CH_2-(CH_2)_5-$ (T-11) $-CH(C_2H_5)-CH(CH_3)-$ (T-12) $-CH(C_3H_7)-CH_2-$ (T-13) $-C(CH_3)_2-(CH_2)_2-$ (T-14) $-CH(CH_3)-CH(CH_3)-CH_2-$ (T-15) $-CH(CH_3)-CH_2-CH(CH_3)-$ (T-16) $-CH_2-C(CH_3)_2-CH_2-$ (T-17) $-CH(CH_3)-(CH_2)_3-$ (T-18) $-CH_2-CH(CH_3)-(CH_2)_2-$ (T-19) $-CH(CH_3)-(CH_2)_4-$ (T-20) $-CH_2-CH(CH_3)-(CH_2)_3-$ (T-21) $-(CH_2)_2-CH(CH_3)-(CH_2)_2-$ (T-22) $-CH_2-C(CH_3)_2-(CH_2)_2-$ (T-23)

(T-24)

-continued (T-25) $-CH_2-CH(CH_3)-(CH_2)_4-$ (T-26) $-CH_2-CH(CH_3)-CH_2-CH(CH_3)-CH_2-$ (T-27) $-CH_2-CH(C_2H_5)-(CH_2)_4-$ (T-28) $-CH_2-C(C_2H_5)(CH_3)-(CH_2)_3-$ (T-29) $-CH_2-CH(CH_3)-(CH_2)_5-$ (T-30) $-CH_2-C(C_2H_5)(CH_3)-(CH_2)_4-$ (T-31) $-CH_2-CH(CH_3)-(CH_2)_6-$ (T-32) $-CH_2-C(C_2H_5)(CH_3)-(CH_2)_5-$ (T-33) $-(CH_2)_6-$ In the present invention, preferably used, as the aforementioned electric charge transporting polymeric compounds, are the compounds represented by at least one of the general formulas (III)–(V):

$$-\left[\underset{\underset{O}{\|}}{C}-A-\underset{\underset{O}{\|}}{C}-O-(Y-O)_m\right]_p- \quad \text{(III)}$$

$$-\left[\underset{\underset{O}{\|}}{C}-A-\underset{\underset{O}{\|}}{C}-O-(Y-O)_m-\underset{\underset{O}{\|}}{C}-Z-\underset{\underset{O}{\|}}{C}-O-(Y-O)_{m'}\right]_p- \quad \text{(IV)}$$

$$-\left[\underset{\underset{O}{\|}}{C}-A-\underset{\underset{O}{\|}}{C}-O-(Y-O)_m\right]_q-\left[\underset{\underset{O}{\|}}{C}-Z-\underset{\underset{O}{\|}}{C}-O-(Y-O)_{m'}\right]_r \quad \text{(V)}$$

where A represents the structure indicated by the aforementioned general formula (I-1) or (I-2), Y and Z are each a divalent hydrocarbon radical, m and m' are each an integer of 1–5, p is an integer of 5–5,000, q is an integer of 5–5,000, r is an integer of 1–3,500 and the sum of q+r is an integer of 5–5,000 with the provision that $1>q/(q+r)\geqq 0.3$. Y is preferably selected from the following groups (19)–(25):

$$-(CH_2)_d- \quad (19)$$

$$-(CH_2CH_2O)_e-(CH_2CH_2)- \quad (20)$$

(21)

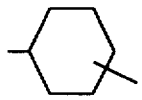

-continued (22)

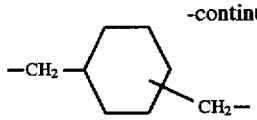

(23)

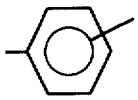

(24)

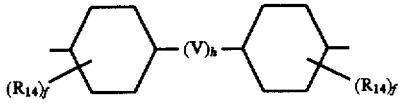

(25)

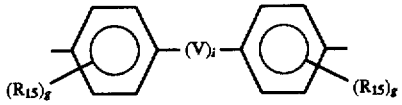

where $R_{14}$ and $R_{25}$ are selected from the group consisting of hydrogen, an alkyl radical of 1–4 carbon atoms, an alkoxy radical of 1–4 carbon atoms, a substituted or unsubstituted phenyl radical, a substituted or unsubstituted aralkyl radical and halogen, d and e are each an integer of 1–10, f and g are each an integer of 0, 1 or 2, and h and i are each an integer of 0 or 1. V is the same as the aforementioned one.

Z is preferably an alkylene radical of 1–10 carbon atoms, an o-, m- or p-phenylene radical, a naphthalene radical or a biphenylene radical.

Given below are specific examples of the above-mentioned electric charge transporting polymeric compounds. Tables 1–3 shows examples of the structure represented by the general formula (I-1), Tables 4–6 show examples of the structure represented by the general formula (I-2), Tables 7 and 8 show examples of the structure represented by the general formula (III), Table 9 shows examples of the structure represented by the general formula (IV) and Table 10 shows examples of the structure represented by the general formula (V).

Examples of the compounds represented by the general formula (I-1)

TABLE 1

| CN | X | $R_1$ | $R_2$ | PB | k | T |
|---|---|---|---|---|---|---|
| 1 | 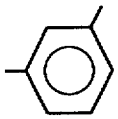 | H | H | 3 | 0 | T-2 |
| 2 | 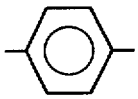 | H | H | 3 | 0 | T-2 |
| 3 | 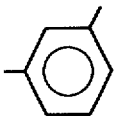 | 3-Me | 4-Me | 3 | 0 | T-2 |
| 4 | 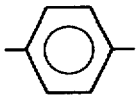 | 3-Me | 4-Me | 4 | 0 | T-2 |

TABLE 1-continued

| CN | X | $R_1$ | $R_2$ | PB | k | T |
|---|---|---|---|---|---|---|
| 5 | 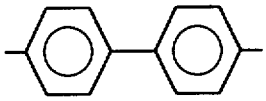 | H | H | 3 | 1 | — |
| 6 | " | H | H | 3 | 1 | T-2 |
| 7 | " | H | H | 3 | 1 | T-51 |
| 8 | " | H | 4-Me | 3 | 1 | T-2 |
| 9 | " | H | 4-Ph | 3 | 1 | T-2 |
| 10 | " | 3-Me | 4-Me | 3 | 1 | T-81 |
| 11 | " | 3-Me | 4-Me | 3 | 1 | T-251 |
| 12 | " | H | H | 4 | 1 | T-5r |
| 13 | " | H | H | 4 | 1 | T-1 |
| 14 | " | H | H | 4 | 1 | T-2 |

CN: Compound number
PB: Position for bonding (, which are the same as in all the tables.)
": ditto

TABLE 2

| CN | X | $R_1$ | $R_2$ | PB | k | T |
|---|---|---|---|---|---|---|
| 15 | 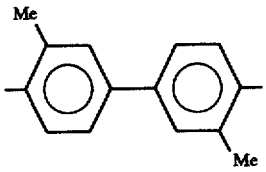 | 3-Me | 4-Me | 3 | 1 | — |
| 16 | " | H | H | 3 | 1 | T-2 |
| 17 | " | H | 4-Me | 3 | 1 | T-2 |
| 18 | " | 3-Me | 4-Me | 4 | 1 | T-1 |
| 19 | " | 3-Me | 4-Me | 4 | 1 | T-2 |
| 20 | " | 3-Me | 4-Me | 4 | 1 | T-4 |
| 21 | " | 3-Me | 5-Me | 4 | 1 | T-2 |
| 22 | " | 3-Me | 4-Me | 4 | 1 | T-51 |
| 23 | " | 4-Me | H | 4 | 1 | T-131 |
| 24 | 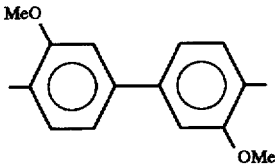 | H | H | 3 | 1 | — |
| 25 | " | H | H | 3 | 1 | T-2 |
| 26 | " | H | 4-Me | 3 | 1 | T-2 |
| 27 | " | H | 4-Ph | 3 | 1 | T-2 |
| 28 | " | 3-Me | 4-Me | 3 | 1 | T-81 |

TABLE 3

| CN | | $R_1$ | $R_2$ | PB' | k | T |
|---|---|---|---|---|---|---|
| 29 | 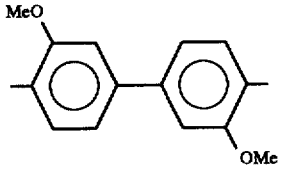 | 3-Me | 4-Me | 3 | 1 | T-251 |
| 30 | " | H | H | 4 | 1 | T-5r |
| 31 | " | 3-Me | 4-Me | 4 | 1 | T-2 |
| 32 | " | 4-Me | H | 4 | 1 | T-171 |

TABLE 3-continued

| CN | | $R_1$ | $R_2$ | PB' | k | T |
|---|---|---|---|---|---|---|
| 33 | 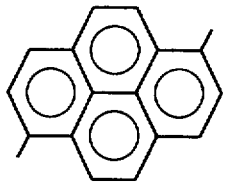 | H | H | 3 | 1 | T-2 |
| 34 | " | H | 4-Me | 3 | 1 | T-81 |
| 35 | " | 3-Me | 4-Me | 3 | 1 | T-181 |
| 36 | " | H | H | 4 | 1 | T-201 |
| 37 | " | 4-Me | H | 4 | 1 | T-241 |
| 38 | 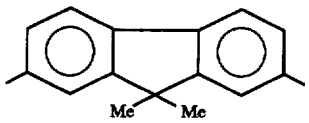 | H | H | 3 | 1 | T-2 |
| 39 | " | H | 4-Me | 3 | 1 | T-81 |
| 40 | " | 3-Me | 4-Me | 3 | 1 | T-181 |
| 41 | " | H | H | 4 | 1 | T-201 |
| 42 | " | 4-Me | H | 4 | 1 | T-241 |

TABLE 4

Examples of the compounds represented by the general formula (I-2)

| CN | X | $R_3$ | $R_4$ | PB | k | T |
|---|---|---|---|---|---|---|
| 43 | 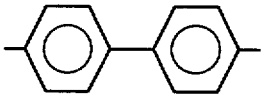 | H | H | 4,4' | 0 | T-1 |
| 44 | " | H | H | 4,4' | 0 | T-2 |
| 45 | " | 3-Me | 4-Me | 4,4' | 0 | — |
| 46 | " | 3-Me | 4-Me | 4,4' | 0 | T-2 |
| 47 | " | H | H | 4,4' | 1 | T-1 |
| 48 | " | H | H | 4,4' | 1 | T-2 |
| 49 | " | H | H | 4,4' | 1 | T-51 |
| 50 | " | H | 4-Me | 4,4' | 1 | T-2 |
| 51 | " | H | 4-Ph | 4,4' | 1 | T-2 |
| 52 | " | 3-Me | 4-Me | 4,4' | 1 | T-81 |
| 53 | " | 3-Me | 4-Me | 4,4' | 1 | T-251 |
| 54 | " | H | H | 4,4' | 1 | T-5r |
| 55 | " | 3-Me | 4-Me | 4,4' | 1 | T-1 |
| 56 | " | 4-Me | H | 4,4' | 1 | T-2 |

TABLE 5

| CN | X | $R_3$ | $R_4$ | PB | k | T |
|---|---|---|---|---|---|---|
| 57 | 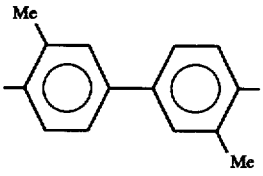 | H | H | 4,4' | 1 | — |
| 58 | " | H | H | 4,4' | 1 | T-2 |
| 59 | " | H | 4-Me | 4,4' | 1 | T-2 |
| 60 | " | H | 4-Ph | 4,4' | 1 | T-1 |

TABLE 5-continued

| CN | X | $R_3$ | $R_4$ | PB | k | T |
|---|---|---|---|---|---|---|
| 61 | " | 3-Me | 4-Me | 4,4' | 1 | T-2 |
| 62 | " | 3-Me | 4-Me | 4,4' | 1 | T-4 |
| 63 | " | H | H | 4,4' | 1 | T-5r |
| 64 | " | 3-Me | 4-Me | 4,4' | 1 | T-51 |
| 65 | " | 4-Me | H | 4,4' | 1 | T-131 |
| 66 | 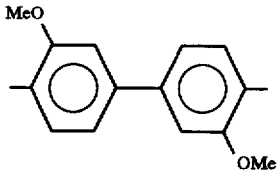 | H | H | 4,4' | 1 | — |
| 67 | " | H | H | 4,4' | 1 | T-2 |
| 68 | " | H | 4-Me | 4,4' | 1 | T-2 |
| 69 | " | H | 4-Ph | 4,4' | 1 | T-2 |
| 70 | " | 3-Me | 4-Me | 4,4' | 1 | T-81 |

TABLE 6

| CN | X | $R_3$ | $R_4$ | PB | k | T |
|---|---|---|---|---|---|---|
| 71 | 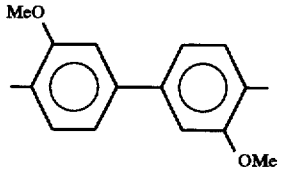 | 3-Me | 4-Me | 4,4' | 1 | T-251 |
| 72 | " | H | H | 4,4' | 1 | T-5r |
| 73 | " | 3-Me | 4-Me | 4,4' | 1 | T-2 |
| 74 | " | 4-Me | H | 4,4' | 1 | T-171 |
| 75 | 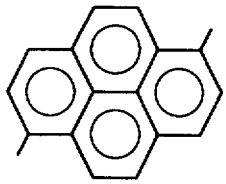 | H | H | 4,4' | 1 | T-2 |
| 76 | " | H | 4-Me | 4,4' | 1 | T-81 |
| 77 | " | 3-Me | 4-Me | 4,4' | 1 | T-181 |
| 78 | " | H | H | 4,4' | 1 | T-201 |
| 79 | " | 4-Me | H | 4,4' | 1 | T-241 |
| 80 | 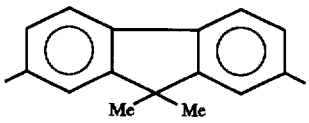 | H | H | 4,4' | 1 | T-2 |
| 81 | " | H | 4-Me | 4,4' | 1 | T-81 |

TABLE 6-continued

| CN | X | $R_3$ | $R_4$ | PB | k | T |
|---|---|---|---|---|---|---|
| 82 | " | 3-Me | 4-Me | 4,4' | 1 | T-181 |
| 83 | " | H | H | 4,4' | 1 | T-201 |
| 84 | " | 4-Me | H | 4,4' | 1 | T-241 |

TABLE 7

Examples of compounds represented by the general formula (III)

| CN | Partial constitution: constitution | Partial constitution: Ratio | Y | m | p |
|---|---|---|---|---|---|
| 85 | 6 | — | $-CH_2CH_2-$ | 1 | 165 |
| 86 | 6 | — | " | 2 | 55 |
| 87 | 6 | — | 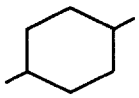 | 1 | 35 |
| 88 | 6 | — | 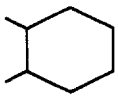 | 1 | 40 |
| 89 | 6 | — | 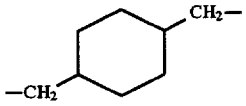 | 1 | 30 |

TABLE 7-continued

Examples of compounds represented by the general formula (III)

| CN | Partial constitution: constitution | Partial constitution: Ratio | Y | m | p |
|---|---|---|---|---|---|
| 90 | 3 | — | $-CH_2CH_2-$ | 1 | 230 |
| 91 | 19 | — | " | 1 | 165 |
| 92 | 21 | — | " | 1 | 150 |
| 93 | 26 | — | " | 1 | 200 |
| 94 | 33 | — | " | 2 | 60 |
| 95 | 39 | — | " | 1 | 145 |

TABLE 8

| CN | Partial constitution: constitution | Partial constitution: Ratio | Y | m | p |
|---|---|---|---|---|---|
| 97 | 46 | — | $-CH_2CH_2-$ | 1 | 210 |
| 98 | 47 | — | " | 2 | 140 |
| 99 | 48 | — | " | 1 | 150 |
| 100 | 61 | — | " | 1 | 175 |
| 101 | 68 | — | " | 1 | 175 |
| 102 | 73 | — | " | 1 | 180 |
| 103 | 6/19 | 1/1 | " | 1 | 200 |
| 104 | 6/48 | 1/1 | " | 1 | 170 |
| 105 | 22/47 | 1/1 | " | 1 | 160 |
| 106 | 22/48 | 1/1 | " | 2 | 155 |
| 107 | 22/75 | 1/1 | " | 1 | 180 |

TABLE 9

Examples of compounds represented by the general formula (IV)

| CN | Partial constitution: constitution | Partial constitution: Ratio | Y | Z | m | p |
|---|---|---|---|---|---|---|
| 108 | 6 | — | $-CH_2CH_2-$ | 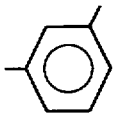 | 1 | 20 |
| 109 | 6 | — | " | 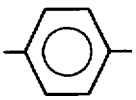 | 1 | 15 |
| 110 | 19 | — | " | " | 1 | 35 |
| 112 | 19 | — | " | $-CH_2CH_2-$ | 1 | 45 |
| 113 | 19 | — | 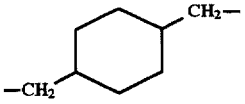 | 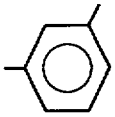 | 1 | 20 |
| 114 | 48 | — | $-CH_2CH_2-$ | " | 1 | 15 |

TABLE 10

Examples of compounds represented by the general formula (V)

| CN | Partial constitution: constitution | Partial constitution: Ratio | Y | m | Z | q | r |
|---|---|---|---|---|---|---|---|
| 122 | 6 | — | $-CH_2CH_2-$ | 1 | $-(CH_2)_4-$ | 140 | 35 |
| 123 | 6 | — | " | 2 | $-(CH_2)_4-$ | 115 | 15 |
| 124 | 6 | — | " | 1 | $-(CH_2)_8-$ | 150 | 30 |
| 125 | 19 | — | " | 1 | $-(CH_2)_8-$ | 90 | 60 |
| 126 | 19 | — | " | 1 | 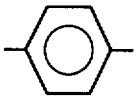 | 110 | 70 |
| 127 | 19/21 | 1/1 | " | 1 | $-(CH_2)_8-$ | 110 | 40 |
| 128 | 17 | — | " | 1 | $-(CH_2)_4-$ | 85 | 85 |
| 129 | 17 | — | " | 2 | $-(CH_2)_4-$ | 45 | 45 |
| 130 | 17 | — | " | 1 | $-(CH_2)_8-$ | 80 | 40 |
| 131 | 38 | — | $-CH_2CH_2CH_2-$ | 1 | 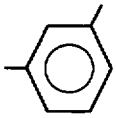 | 60 | 30 |
| 132 | 47 | — | $-CH_2CH_2-$ | 1 | $-(CH_2)_4-$ | 130 | 30 |
| 133 | 47 | — | " | 1 | $-(CH_2)_{10}-$ | 130 | 10 |
| 134 | 48 | — | " | 1 | $-(CH_2)_4-$ | 115 | 50 |
| 135 | 48 | — | " | 1 | $-(CH_2)_6-$ | 120 | 30 |
| 136 | 75 | — | " | 3 | $-(CH_2)_8-$ | 60 | 20 |
| 137 | 19/47 | 1/1 | " | 1 | $-(CH_2)_8-$ | 80 | 40 |
| 138 | 21/48 | 1/1 | $-CH_2CH_2CH_2-$ | 1 | $-(CH_2)_8-$ | 80 | 60 |
| 139 | 21/61 | 1/1 | $-CH_2CH_2-$ | 1 | $-(CH_2)_6-$ | 110 | 40 |

In the present invention, the electric charge transporting layer consists essentially of the aforementioned electric charge transporting polymeric compound alone, but it may comprise other ingredient(s) in combination with the polymeric compound. As other ingredients, preferred are polycarbonate resins, particularly polycarbonate resins represented by the following general formulas (A)–(G). These polycarbonate resins make it possible to decrease the amount of the electric charge transporting ingredient in the electric charge transporting layer to improve durability against discharge products, and also to maintain or enhance mechanical properties.

A

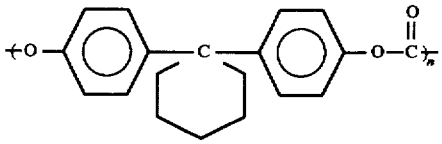

B

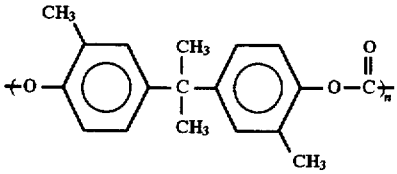

-continued

C

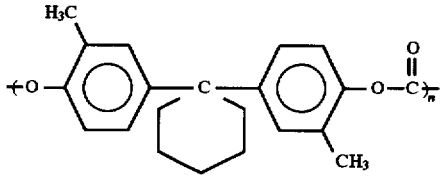

E

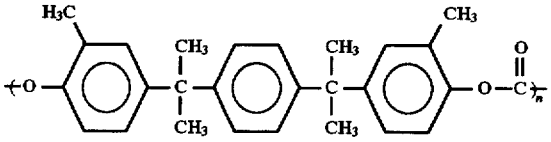

F

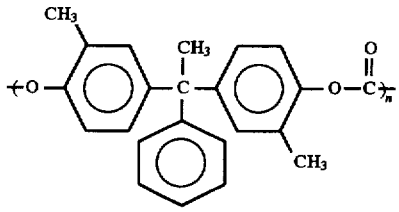

G

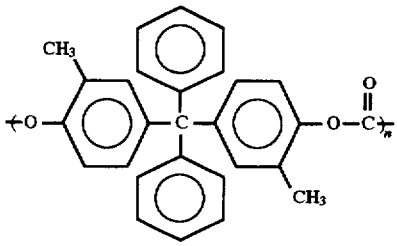

In the above formulas, n takes a value such that the viscosity average molecular weight of the resin is 20,000–100,000.

The liquid developers, which can be used in the present invention, are those commonly used. That is, the liquid developers that can be used are those which contain toner particles having a dye or a pigment dispersed in a binder resin, an electrically insulating liquid and an electric charge adjusting agent.

The dyes and pigments that can be used in the liquid developers include inorganic pigments, such as carbon black, Prussian blue and titanium oxide, azo pigments, such as fast yellow, disazo-yellow, pyrazolone red chelate red, brilliant carmine and para-brown, phthalocyanine pigments, such as copper phthalocyanine, chlorinated copper phthalocyanine and metal-free phthalocyanine, organic pigments, such as quinacridone-based, anthraquinone-based, perylene-based, perynone-based, thiaindigo-based and dioxane-based pigments, dispersed dyes, oil-soluble dyes, and the like.

The binder resins that can be used in the liquid developers are acrylic resins, such as polyacrylates and polymethacrylates, polystyrene, polyethylene-based resins, such as polyethylene/acrylic acid copolymers and polyethylene/vinyl acetate copolymers, polyvinyl chloride resins, nitrocellulose, alkyd resins, phenol resins, polyester resins, polyvinyl butyral resins, polyisocyanate resins, polyurethane resins, polyamide resins, epoxy resins, and the like. However, the binder resins are not limited to the above-mentioned resins.

The electrically insulating liquids that can be used in the liquid developers are usually hydrocarbon solvents having a dielectric constant of not greater than 3.5 and a volume resistivity of not less than $10^7$ Ωcm. The preferred examples of these liquids are those having a boiling point in the range of 150°–220° C. such as aliphatic hydrocarbons, aromatic hydrocarbons and mixtures thereof. Specifically, they include "Isoper" G, H and L (available From Exxon Chemicals and mainly based on isoparaffin), "Shellsol" A and B (available From Shell Chemicals) and "Naphthesol" L, M and H (available From Nippon Petroleum).

The electric charge adjusting agents that can be used in the liquid developers include cobalt naphthenate, zinc naphthenate, copper naphthenate, manganese naphthenate, lecithin, cobalt octylate and zirconium octylate. However, the electric charge adjusting agents are not limited to these compounds.

Particularly preferred is lecithin containing 40–90% by weight of phosphatidylethanolamine or phosphatidylserine.

In the liquid developer, the ratios of the ingredients may be any of those which are adopted in the art.

Below, the photosensitive body for electrophotography of the present invention will be explained with reference to drawings.

Figure 2:
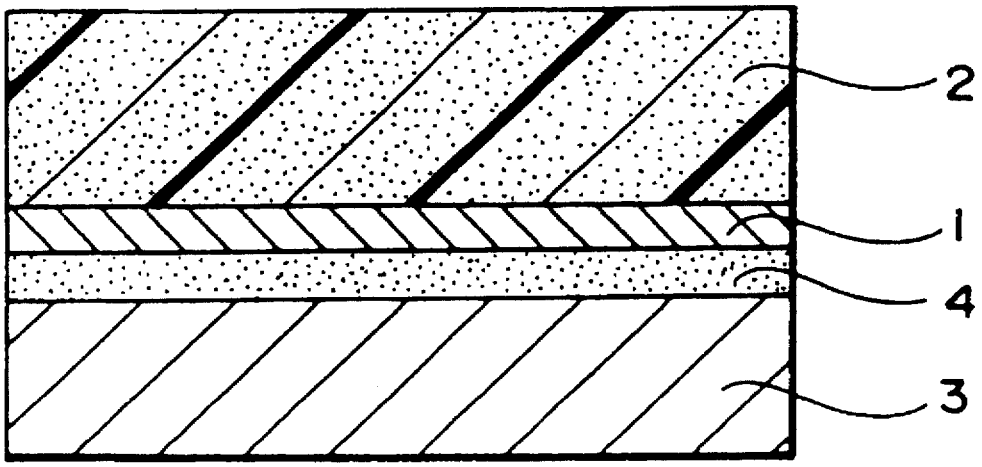
FIG. 2 is a schematically illustrated cross-sectional view of another example of the photosensitive body of the present invention.
Figure 3:
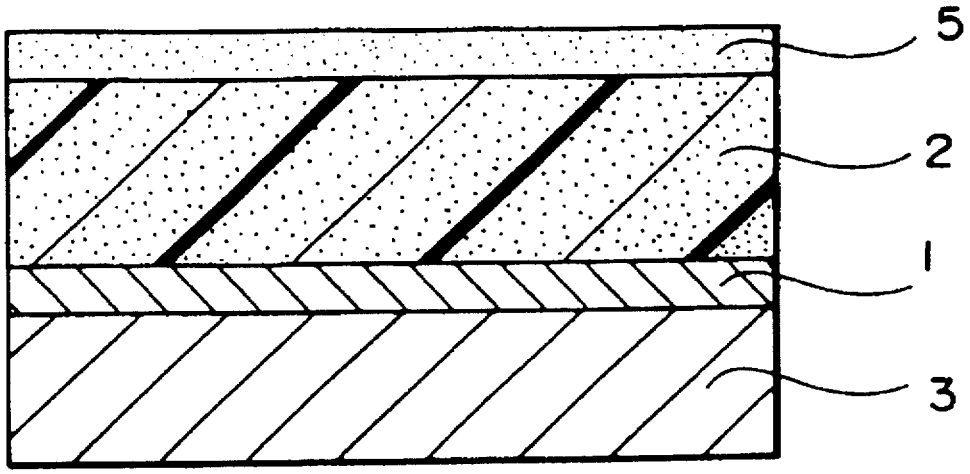
FIG. 3 is a schematically illustrated cross-sectional view of other example of the photosensitive body of the present invention.
Figure 4:
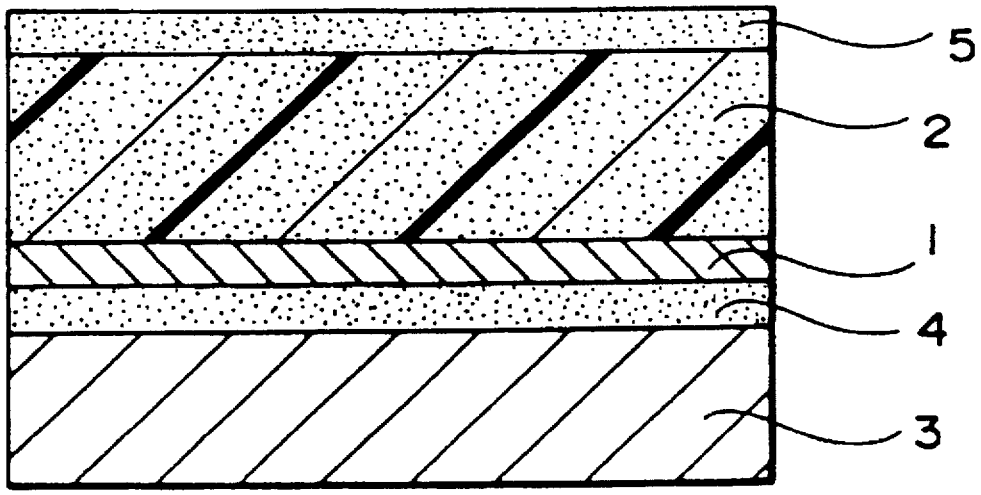
FIG. 4 is a schematically illustrated cross-sectional view of other example of the photosensitive body of the present invention.
Figure 5:
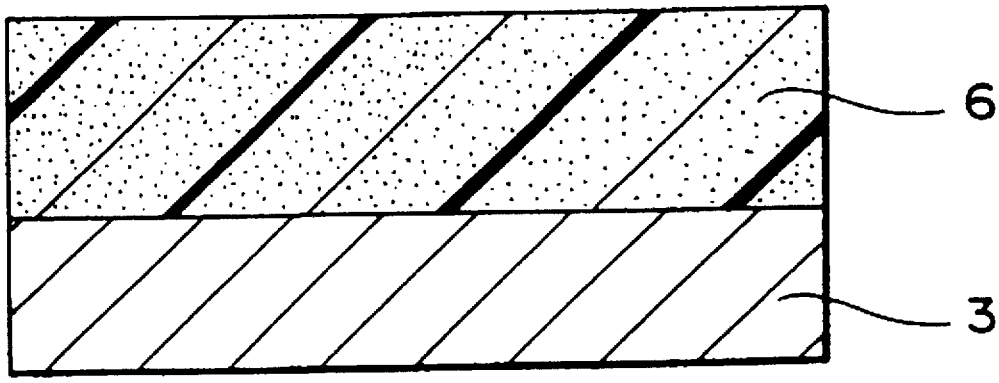
FIG. 5 is a schematically illustrated cross-sectional view of other example of the photosensitive body of the present invention.
Figure 6:
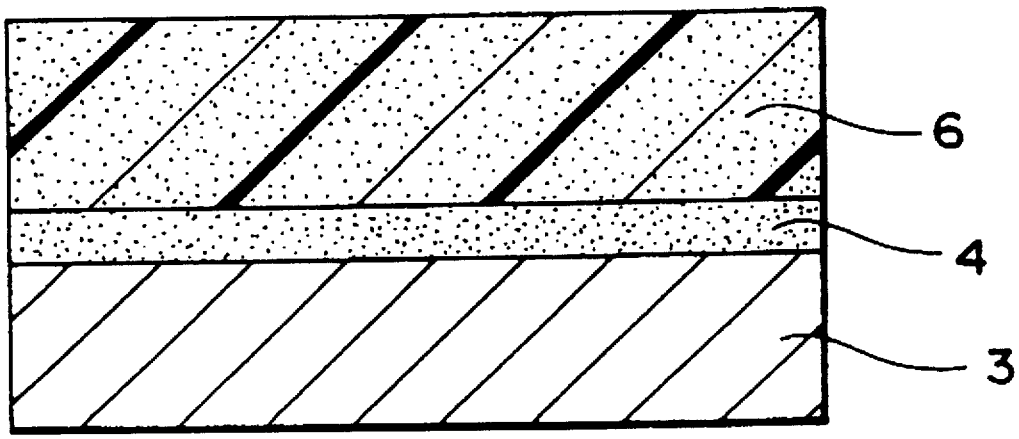
FIG. 6 is a schematically illustrated cross-sectional view of other example of the photosensitive body of the present invention.

FIGS. 1–6 respectively schematically illustrate cross-sectional views of the photosensitive body for electrophotography of the present invention. FIG. 1 shows a photosensitive body which has an electric charge generating layer 1 and an electric charge transporting layer 2 formed on an electroconductive support 3. FIG. 2 shows a photosensitive body which has an underlayer 4 on an electroconductive support 3. FIG. 3 shows a photosensitive body which has a protective layer 5 on the surface. FIG. 4 shows a photosensitive body which has the structure shown in FIG. 1 and additionally has an underlayer 4 on the electroconductive support 3 and a surface protective layer 5. FIG. 5 shows a photosensitive body which has a photoconductive layer 6 formed on an electroconductive support 1. FIG. 6 shows a photosensitive body which has an underlayer 4 on an electroconductive support 3. FIGS. 1–4 relate to the case where the photosensitive layer has a laminate structure, while FIGS. 5 and 6 relate to the case where the photosensitive layer has a single-layer structure.

Examples of the electroconductive support 3 include metals, such as aluminum, nickel, chromium and stainless steel, plastic films coated with a thin layer of materials, such as aluminum, titanium, nickel, chromium, stainless steel, gold, vanadium, tin oxide, indium oxide and ITO, and a paper or plastic film coated with or impregnated with an electroconductivity imparting agent. The electroconductive support 3 may be used in an appropriate shape such as a drum, a sheet, a plate or the like, but is not limited to such shapes. In addition, if necessary, the surface of the electroconductive support 3 may receive a variety of treatments, in so far as these treatments do not impair the quality of image. For example, the treatments include the anodizing, hot water oxidizing treatment, chemical treatment, coloring treatment and irregular reflection creating treatment by means of the sanding of the surface.

In the photosensitive body for electrophotography of the present invention, the photosensitive layer, which is formed on the electroconductive support 3, may be a laminate structure comprising discrete functions divided into the electric charge generating layer 1 and the electric charge transporting layer 2 formed on the electroconductive support 3, as shown in FIGS. 1–4, or otherwise it may be the photoconductive layer 6 of a single-layer structure, as shown in FIGS. 5 and 6. The photosensitive layer comprises a coating film which contains an electric charge generating material or an electric charge transporting polymeric compound or both of them.

In the case where the photosensitive layer takes a laminate structure, any one of the electric charge generating layer 1 and the electric charge transporting layer 2 may be placed over the other. However, the explanation given below will center on the case where the electric charge transporting layer 2 forms the upper layer. The electric charge generating layer 1 may be formed either by the vacuum deposition of an electric charge generating material or by applying a coating liquid which comprises an electric charge generating material dispersed in a binder resin in an organic solvent. The examples of the electric charge generating material used in the present invention include inorganic photoconductive materials, such as amorphous selenium, a crystalline selenium-tellurium alloy, a selenium-arsenic alloy, other selenium compounds and selenium-based alloys, granular selenium, zinc oxide and titanium oxide and organic pigments and dyes such as phthalocyanine, squalene, anthoanthrone, perylene, azo, anthraquinone, pyrene, pyrilium salts and thiapyrilium salts.

Of the above-mentioned examples, a photosensitive body which utilizes a phthalocyanine pigment, particularly metal-free phthalocyanine, titanyl phthalocyanine and gallium phthalocyanine has a high sensitivity in the range of near-infrared semiconductor laser wave (780–830 nm) and exhibits stable electrical properties over a long period of time.

Preferred examples of these phthalocyanine pigments include gallium phthalocyanine, which shows strong diffraction peaks at least at 6.8°, 12.8°, 15.8° and 26.0° at Bragg angle (2θ±0.2°) of X-ray diffraction spectrum obtained by using CuK α, hydroxygallium phthalocyanine, which shows strong diffraction peaks at least at 7.5°, 9.9°, 12.5°, 16.3°, 18.6°, 25.1°, and 28.3° at Bragg angle (2θ±0.2°) of X-ray diffraction spectrum by CuK α (see FIG. 7), and chloro-gallium phthalocyanine, which shows strong diffraction peaks at least at 7.4°, 16.6°, 25.5° and 28.3° at Bragg angle (2θ±0.2°) of X-ray diffraction spectrum by CuK α.

In the visible wave length range, the anthoanthrone pigment exhibits stable electrical properties over along period of time, while granular selenium, particularly granular, trigonal selenium, exhibits stable electrical properties and a high sensitivity over a long period of time.

Examples of the binder resin in the electric charge generating layer 1 include polyvinylbutyral resins, polyvinylformal resins, polyvinylacetal resins such as partially acetalized polyvinylacetal resins, which have a part of butyral modified with formal, acetoacetal or the like, polyamide resins, polyester resins, modified ether-type polyester resins, polycarbonate resins, acrylic resins, polyvinyl chloride resins, polyvinylidene chloride resins, polystyrene resins, polyvinyl acetate resins, vinylchloride/vinylacetate copolymers, silicone resins, phenol resins, phenoxy resins, melamine resins, benzoguanamine resins, urea resins, polyurethane resins, poly-N-vinylcarbazole resins, polyvinyl anthrathene resins and polyvinylpyrene.

Of these resins, particularly, polyvinyl acetal resins, vinylchloride/vinylacetate copolymers, phenoxy resins and modified ether-type polyester resins are capable of satisfactorily dispersing the above-mentioned phthalocyanine pigments, anthoanthrone pigments and granular, trigonal selenium to prevent coagulation of pigments and to provide a coating liquid stable for a long period or time. Use of such coating liquid provides a uniform film, thus leading to better electrical properties and less defects of image. However, the resins to be used in the present invention are not limited to the above-mentioned resins, provided that the resins can form a coating film in an ordinary condition. These binder resins may be used alone or in combination of two or more of them.

The blending ratio of the electric charge generating material to the binder resin is preferably in the range of 5:1 to 1:2 by volume.

Examples of solvent to be used in preparing the coating liquid are conventional organic solvents such as methanol, ethanol, n-propanol, n-butanol, benzylalcohol, methylcellosolve, ethylcellosolve, acetone, methyl ethyl ketone, cyclohexanone, chlorobenzene, methyl acetate, n-butyl acetate, dioxane, tetrahydrofuran, methylene chloride and chloroform. These solvents may used alone or in combination of two or more of them.

The coating methods of the coating liquid are commonly used methods such as blade coating, Meyer bar coating, spraying, immersion coating, bead coating, air knife coating and curtain coating. Appropriate thickness of the electric charge generating layer 1 is in the range of 0.01–5 μm and preferably in the range of 0.1–2.0 μm. The uniform formation of the electric charge generating layer 1 becomes difficult if the thickness is less than 0.01 μm, while the properties of the electrophotography tend to be seriously impaired if the thickness exceeds 5 μm.

The preferable weight average molecular weight (Mw) of the electric charge transporting polymeric compound in the present invention is in the range of 5,000–750,000 and most preferably in the range of 50,000–500,000. In the case where the blend of the electric charge transporting polymeric compound and the aforementioned polycarbonate is used, the blending ratio (by weight) of the electric charge transporting polymeric compound to the aforementioned polycarbonate is preferably from 5:1 to 1:1.

For the preparation of the electric charge transporting layer 2 of the photosensitive body for the electrophotography of the present invention, an antioxidant may be used which includes paraphenylene diamine, arylalkane, hydroquinone, spirochroman, spiroindanone, derivatives thereof, organosulfur compounds and organophosphorus compounds. A photostabilizer, such as a derivative of benzophenone, benzotriazole, dithiocarbamate and tetramethyl pyperidine, may be added to the electric charge transporting layer 2. In addition, for the purpose of increasing sensitivity, decreasing residual potential, decreasing fatigue due to repetitive use, etc., at least one electron acceptor material may be incorporated into the electric charge transporting layer 2. The examples of the electron acceptor material usable in the photosensitive body of the present invention include succinic anhydride, maleic anhydride, dibromomaleic anhydride, phthatic anhydride, tetrabromophthalic anhydride, tetracyano ethylene, tetracyanoquinodimethane, o-dinitrobenzene, m-dinitrobenzene, chloranyl, dinitroanthraquinone, trinitrofluorenone, picric acid, o-nitrobenzoic acid, p-nitrobenzoic acid and phthalic acid. Of these compounds, particularly preferred are fluorenone-, quinone-compounds, and benzene derivatives which have electron attracting substituents such as Cl, CN and $NO_2$.

In the present invention, for the main purpose of providing a good surface to the photosensitive layer, an additive may be incorporated into the uppermost layer of the photosensitive layer. The compound which is known as a modifier of paints can be used as the additive. Preferred examples include alkyl-modified silicone oils, such as dimethylsilicone oil, and an aromatic-modified silicone oils such as methylphenylsilicone oil. The adding amount of the additive is 1–10,000 ppm and preferably 5–2,000 ppm based on the solid of the electric charge transporting layer.

The examples of solvent to be used in preparing the electric charge transporting layer 2 are conventional organic solvents which include aromatic hydrocarbons, such as benzene, toluene and xylene, halogenated aromatic hydrocarbon, such as chlorobenzene, ketones, such as acetone and methyl ethyl ketone, halogenated aliphatic hydrocarbons, such as methylene chloride, chloroform and ethylene chloride, and cyclic or linear ethers, such as tetrahydrofuran and ethyl ether. These solvents may used alone or in combination of two or more of them.

The coating method of the layer 2 may be any conventional method such as blade coating, Meyer bar coating, spraying, immersion coating, bead coating, air knife coating and curtain coating.

The thickness of the electric charge transporting layer 2 of the present invention is generally in the range of 5–70 μm and preferably in the range of 10–50 μm. The potential of initial electrostatic charge tnds to drop if the thickness is less than 5 μm, while the properties of the electrophotography and quality of image tend to be impaired if the thickness exceeds 70 μm.

The electric charge transporting layer 2 can also be suitably used as a protective layer by providing it on an electric charge transporting layer that comprises a group of other compounds. The examples of the foregoing electric charge transporting layer include the aforementioned electric charge transporting polymeric compounds, a combination of the electric charge transporting polymeric compound and a polycarbonate resin, and a product made by dispersing a conventional, low molecular weight, electric charge transporting material in a binder resin.

In the case where the photosensitive layer of the photosensitive body for the electrophotography of the present invention has a single-layer structure, an electric charge generating material, an electric charge transporting polymeric compound and a polycarbonate resin-containing compound may be the same as those in the case where the photosensitive layer has a laminate structure. Further, the photosensitive layer may contain any of the aforementioned additives, such as antioxidants, photostabilizers and surface smoothening agents, as necessary.

In the single-layer photosensitive body, the suitable proportion of the electric charge generating material to the electric charge transporting polymeric compound is 0.1–20% by weight and preferably 0.5–5% by weight.

A method for coating the electroconductive support 3 with a photosensitive single-layer comprises the steps of uniformly dispersing or dissolving the above-mentioned ingredients in a solvent, examples of which are shown for the case of preparing an electric charge transporting layer, applying the resulting liquid to the support according to the aforementioned conventional method and drying the film. The thickness of the single-layer photosensitive body is generally in the range of 5–70 μm and preferably in the range of 10–40 μm.

In the present invention, an underlayer 4 is preferably provided between the electroconductive support 3 and the photosensitive layer, as shown in FIGS. 2, 4 and 6. The functions of the underlayer 4 include a function as a binding layer bonding the photosensitive layer and the electroconductive support 3 to integrally hold both of them; a function of preventing the intrusion of the electric charge from the electroconductive support 3 to the photosensitive layer at the time when the photosensitive layer bears electric charge; and the prevention of the reflection of the light from the electroconductive support 3, depending on the case.

Examples of the binder resins to be used for the underlayer 4 include known materials such as polyamide resins, vinyl chloride resins, vinyl acetate resins, phenol resins, polyurethane resins, melamine resins, benzoguanamine resins, polyimide resins, polyethylene resins, polypropylene resins, polycarbonate resins, acrylic resins, methacrylic resins, vinylidene chloride resins, polyvinylacetal resins, vinylchloride/vinylacetate copolymers, polyvinyl alcohol resins, water-soluble polyester resins, nitrocellulose, casein, gelatin, polyglutamic acid, starch, starch acetate, amino starch, polyacrylic acid, polyacryl amide, zirconium chelate compounds, titanyl chelate compounds, titanyl alkoxide compounds, organotitanium compounds and the silane coupling agents. These materials may be used alone or in combination of two or more of them.

Further, the material may be blended with such finely divided particles as titanium oxide, aluminium oxide, silicon oxide, zirconium oxide, barium titanate and silicone resins.

The coating method for producing the underlayer 4 include conventional methods such as blade coating, Meyer bar coating, spraying, immersion coating, bead coating, air knife coating and curtain coating. The appropriate thickness of the underlayer 4 is in the range of 0.01–10 μm and preferably in the range of 0.05–2 μm.

In the photosensitive body for the electrophotography of the present invention, a protective layer 5 may be formed on the photosensitive layer. i.e., on the photosensitive layer in the case of a single-layer photosensitive body and on the electric charge transporting layer 2 in the case of a laminate photosensitive body as illustrated in FIGS. 3 and 4.

EXAMPLES

The present invention will be further explained by way of examples below. However, the present invention is not limited to these examples. "Part" in the Examples and Comparative Examples means weight part.

Example 1

To a drum-shaped aluminum substrate there was applied a solution, comprising 10 parts of a zirconium compound ("Orgatics" ZC540 available from Matsumoto Pharmaceuticals Manufacturing Co., Ltd.), 1 part of a silane compound ("A1110" available from Nippon Unicar), 40 parts of i-propanol and 20 parts of butanol, by means of immersion coating, and then the film was dried for 10 minutes at 150° C. to obtain an underlayer of 0.1 μm.

Figure 7:
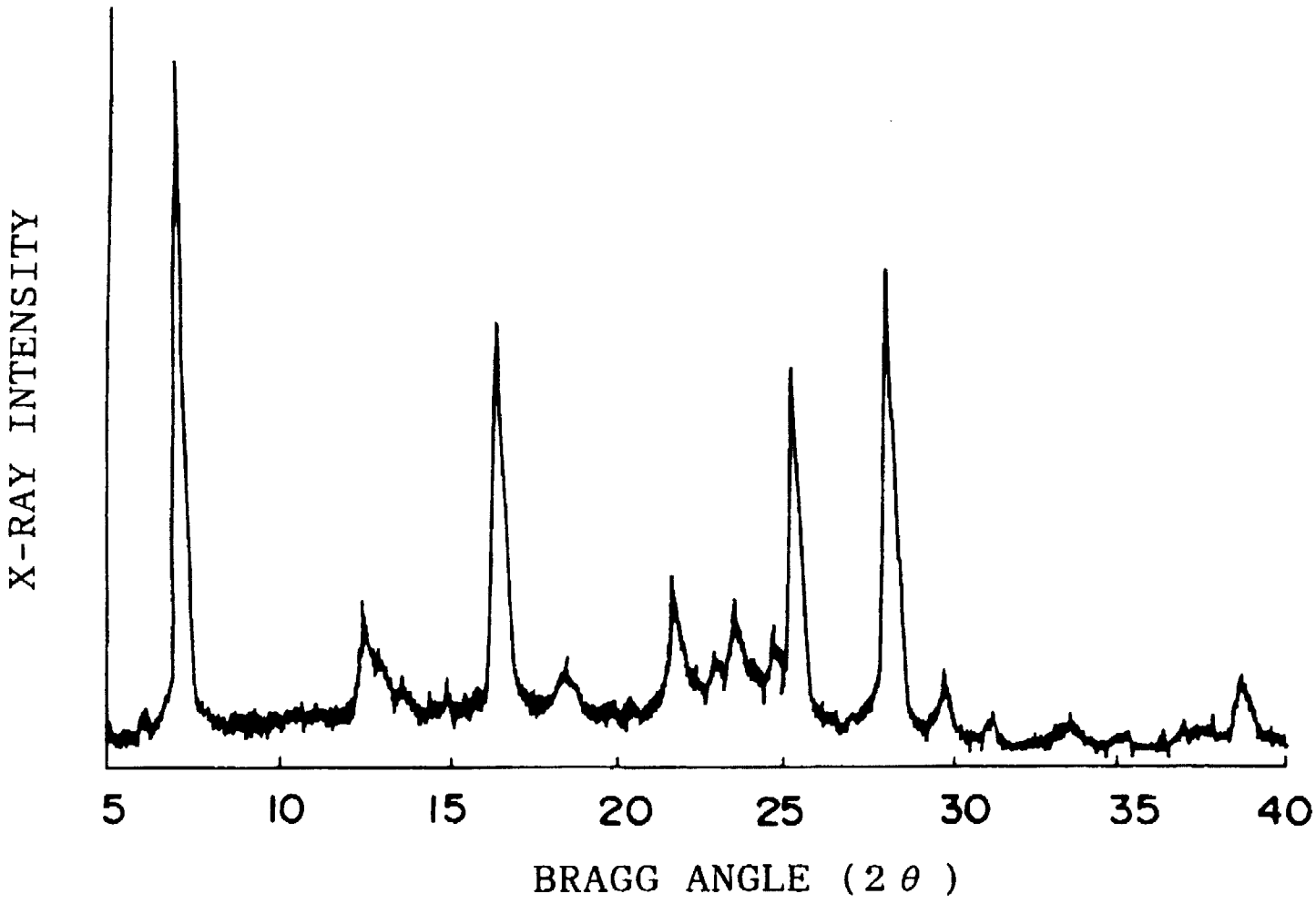
FIG. 7 is a powder X-ray diffraction spectrogram of hydroxygallium phthalocyanine (obtained by use of CuKa) used in Examples.

Next, in order to prepare an electric charge generating material, a mixture, comprising 1 part of hydroxy gallium phthalocyanine having the X-ray diffraction spectrum as shown in FIG. 7, 1 part of a carboxyl-modified vinylchloride/vinylacetate copolymer ("VMCH" available from Union Carbide) and 100 parts of chlorobenzene, was treated in a sand mill with glass beads for 1 hour. The coating liquid thus obtained was applied onto the above-described underlayer by means of immersion coating, and then the film was dried for 10 minutes at 100° C. to obtain an electric charge generating layer of 0.25 μm.

Then, 20 parts of an electric charge transporting polymeric compound, defined as the compound of example 91 (Mw: 110,000), was dissolved in 80 parts of monochlorobenzene. The coating liquid thus obtained was applied onto the above-described electric charge generating layer, and then the film was dried for 60 minutes at 115° to obtain an electric charge transporting layer having a thickness of about 20° μm.

In the above-described manner, a photosensitive body was formed on the drum-shaped aluminum substrate.

Then, an electric charge adjusting agent was prepared by blending 20 parts of lecithin, containing 90% by weight of phosphatidylserine, and 80 parts of Isoper M. Toner liquid was prepared by dispersing 1 part of carbon black, 20 parts of an ethylene/vinylacetate copolymer and 75 parts of Isoper M for 10 minutes in a sand mill, and then adjusting the solid content by use of Isoper M as a diluent so that the resulting mixture would have a solid content of 3 parts. Liquid developer was prepared by blending 100 parts of the toner liquid and 1 part of the electric charge adjusting agent.

The photosensitive body for electrophotography obtained in the above-described manner was mounted on a modified version of FX2700 copying machine (manufactured by Fuji Xerox) having a liquid development device containing the above-described liquid developer. Then, a copying test run, corresponding up to copy on 50,000 sheets of paper, was conducted in an environment of 20° C. and 45%RH to measure the wear amount before and after the copying test and to evaluate the quality of image. The results are shown in Table 11.

Comparative Example 1

A photosensitive body for electrophotography was prepared and evaluated in the same manner as in Example 1, except that a low molecular weight material based electric charge transporting layer resulting from a coating solution, which was made by dissolving 8 parts of a benzidine compound, as an electric charge transporting material, having the structure indicated below, and 12 parts of a polycarbonate resin C as a binder resin (having a viscosity average molecular weight of 45,000) in 80 parts of monochlorobenzene, was used in place of the electric charge transporting polymeric compound as indicated by the compound of example 91 in the electric charge transporting layer of Example 1. The results are shown in Table 11.

Comparative Example 2

A photosensitive body for electrophotography was prepared and evaluated in the same manner as in Example 1, except that a low molecular weight material based electric charge transporting layer resulting from a coating solution, which was made by dissolving 10 parts of a hydrazone compound, as an electric charge transporting material, having the structure indicated below, and 10 parts of a polycarbonate resin F as a binder resin (having a viscosity average molecular weight of 51,000) in 80 parts of monochlorobenzene, was used in place of the electric charge transporting polymeric compound as indicated by the compound of example 91 in the electric charge transporting layer of Example 1. The results are shown in Table 11.

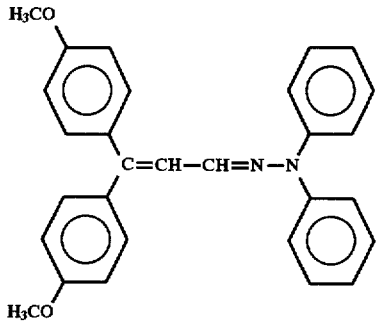

Example 2

A photosensitive body for electrophotography was prepared and evaluated in the same manner as in Example 1, except that an electric charge transporting polymeric compound as indicated by the compound of example 112 (Mw: 53,000) was used in place of the electric charge transporting polymeric: compound as indicated by the compound of example 91 in the electric charge transporting layer Example 1. The results are shown in Table 11.

Example 3

A photosensitive body for electrophotography was prepared and evaluated in the same manner as in Example 1, except that an electric charge transporting polymeric compound as indicated by the compound of example 126(Mw: 83,000) was used in place of the electric charge transporting polymeric compound as indicated by the compound of example 91 in the electric charge transporting layer of Example 1. The results are shown in Table 11.

Example 4

A photosensitive body for electrophotography was prepared and evaluated in the same manner as in Example 1, except that 15 parts of an electric charge transporting polymeric compound as indicated by the compound of example 91 (Mw: 110,000) and 5 parts of polycarbonate C (Viscocity-average molecular weight: 39,000) were used in place of 20 parts of the electric charge transporting polymeric compound as indicated by the compound of example 91 (Mw:110,000) in the electric charge transporting layer of Example 1. The results are shown in Table 11.

Comparative Example 3

A photosensitive body for electrophotography was prepared and evaluated in the same manner as in Example 1, except that an electric charge transporting polymeric compound having a structure as indicated by the general formula given below (Mw: 87,000) was used in place of the electric charge transporting polymeric compound as indicated by the compound of example 91 in the electric charge transporting layer of Example 1. The results are shown in Table 11.

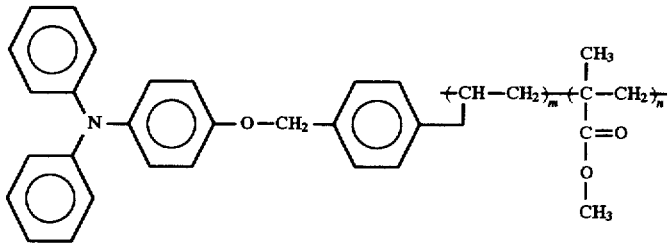

TABLE 11

| | Quality of image after copying 50,000 sheets of paper | Amount of Wear (μm) |
|---|---|---|
| Example 1 | No problem | 2.1 |
| Comparative Example 1 | Occurrence of cracking on the surface of the photosensitive body followed by print out after copying 1,000 sheets of paper | 9.5 |
| Comparative Example 2 | Occurrence of insufficiency of the density of image due to degradation of electrical properties as a result of the dissolution of the electric charge transporting material after copying 500 sheets of paper, evaluation stopped after copying 1,000 sheets of paper | — |
| Example 2 | No problem | 2.8 |
| Example 3 | No problem | 2.3 |
| Example 4 | No problem | 5.5 |
| Comparative Example 3 | Occurrence of print out of scratches of the surface of the photosensitive body after copying 120,000 sheets of paper; occurrence of insufficiency of the density of image after copying 130,000 sheets of paper | 11.0 |

As is apparent from the foregoing results, according to the photosensitive body for electrophotography of the present invention, it is possible to diminish the amount of wear of the photosensitive body. In addition, the photosensitive body withstands a variety of effects for a long time to maintain a high-level quality off image.

What is claimed is:

1. A method for making an image comprising the steps of providing an electric charge to a photosensitive body for electrophotography which has a photosensitive layer on an electroconductive support, forming an electrostatic image on the photosensitive body and forming a visible image by means of a liquid development utilizing a liquid developer for an electrostatic charge latent image, which developer comprises at least toner particles that are made by dispersing a dye or a pigment in a binder resin, an electrically insulating liquid and an electric charge adjusting agent, wherein the photosensitive layer contains as an electric charge transporting material an electric charge transporting polymeric compound which contains as a partial moiety of repeating units at least one of the structures represented by the following general formulas I-1 and I-2, (I-1)

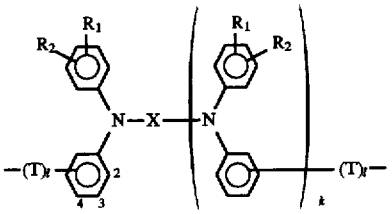

(I-2)

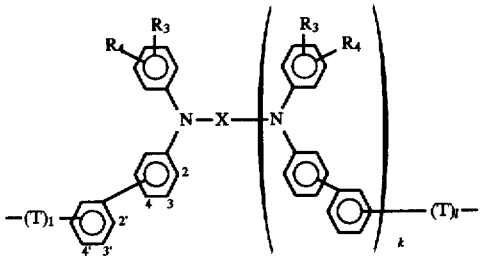

where $R_1$–$R_4$ are each independently selected from the group consisting of hydrogen, an alkyl radical that may have a substituent, an alkoxy radical that may have a substituent, a substituted amino radical, halogen and a substituted or unsubstituted aryl radical, X is a substituted or unsubstituted divalent aryl radical, k and l are each an integer selected from 0 and 1, and T is a divalent hydrocarbon radical of 1–10 carbon atoms that may be branched.

2. The method of claim 1 wherein $R_1$–$R_4$ are each independently hydrogen or an alkyl radical of 1–40 carbon atoms that may have a substituent and X represents as follows:

(1)

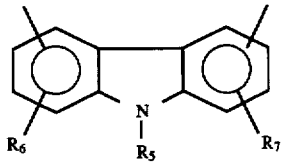

(2)

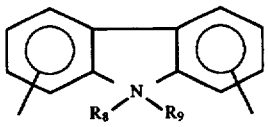

-continued (3)

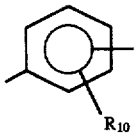

(4)

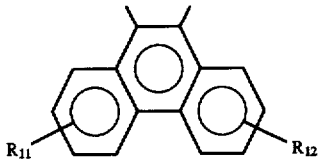

(5)

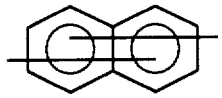

(6)

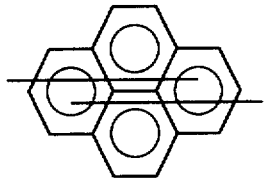

where $R_5$ is selected from the group consisting of hydrogen, an alkyl radical of 1–4 carbon atoms, a substituted or unsubstituted phenyl radical and a substituted or unsubstituted araklyl radical, and $R_6$–$R_{12}$ are each independently selected from the group consisting of hydrogen, an alkyl radical of 1–4 carbon atoms, an alkoxy radical of 1–4 carbon atoms, a substituted or unsubstituted phenyl radical, a substituted or unsubstituted araklyl radical and halogen.

3. The method of claim 2 wherein $R_1$–$R_4$ are each independently hydrogen or an alkyl radical of 1–40 carbon atoms that my have a substituent.

4. The method of claim 1 wherein $R_1$–$R_4$ are each independently hydrogen or an alkyl radical of 1–40 carbon atoms that may have a substituent and X represents as follows:

$$-Ar-(V)_a-Ar- \quad (7)$$

where Ar represents the following group (8), V is selected from the group consisting of the following groups (9)–(18) and a is 0 or 1

(8)

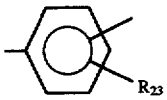

where $R_{23}$ is selected from the group consisting of hydrogen, an alkyl radical of 1–4 carbon atoms, an alkoxy radical of 1–4 carbon atoms, a substituted or unsubstituted phenyl radical, a substituted or unsubstituted araklyl radical and halogen, $$-(CH_2)_b- \quad (9)$$

$$-C(CH_3)_2- \quad (10)$$

$$-O- \quad (11)$$

$$-S- \quad (12)$$

-continued (13)

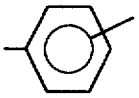

(14)

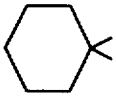

$-C(CF_3)_2-$ (15)

$-Si(CF_3)_2-$ (16)

$-CH=CH-$ (17)

(18)

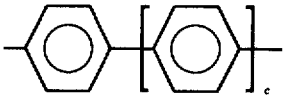

where b is an integer of 1–10 and c is an integer of 1–4.

5. The method of claim 4 wherein $R_1$–$R_4$ are, each independently hydrogen or an alkyl radical of 1–4 carbon atoms that may have a substituent.

6. The method of claim 1 wherein the electric charge transporting polymeric compound is selected from the group consisting of the general formulas (III) to (V):

(III)

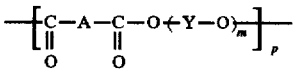

(IV)

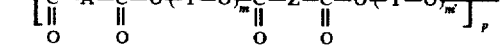

(V)

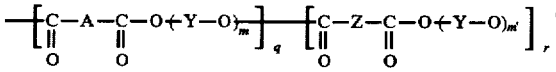

where A represents the structure indicated by the general formula (I-1) or (I-2) of claim 1, Y and Z are each a divalent hydrocarbon radical, m and m' are each an integer of 1–5, p is an integer of 5–5,000, q is an integer of 5–5,000, r is an integer of 1–3,500 and the sum of q+r is an integer of 5–5,000 with the provision that $1>q/(q+r)\geqq 0.3$.

7. The method of claim 1 wherein the photosensitive layer contains the electric charge transporting polymeric compound and a polycarbonate resin having at least one repeating unit structure selected from the group consisting of the general formulas (A) to (G):

A

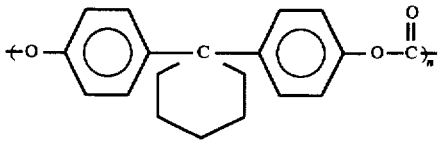

B

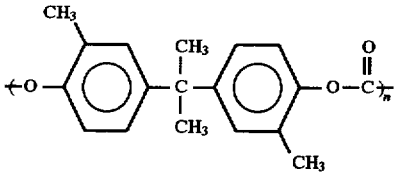

-continued

C

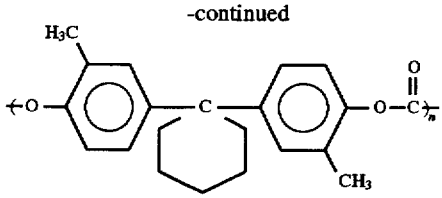

E

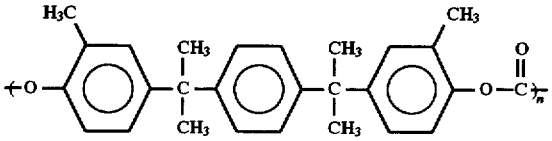

F

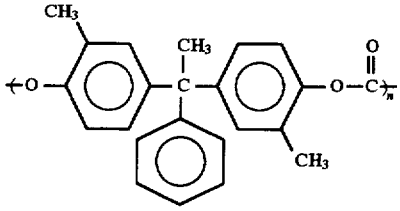

G

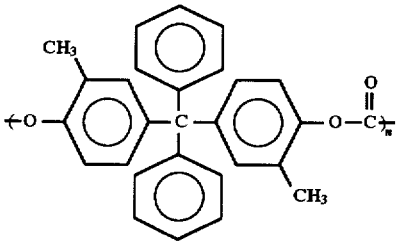

where n takes a value such that the viscosity average molecular weight of the resin is 20,000–100,000.

8. The method of claim 6 wherein the photosensitive layer comprises a plurality of layers whose uppermost layer contains the electric charge transporting polymeric compound selected from the group consisting of the general formulas (III) to (V) of claim 6.

9. The method of claim 6 wherein the photosensitive layer has a structure made by consecutively laminating an electric charge generating layer and an electric charge transporting layer and the electric charge transporting layer contains an electric charge transporting polymeric compound selected from the group consisting of the general formulas (III) to (V) of claim 6.

10. The method of claim 8 wherein the uppermost layer further contains a polycarbonate resin having at least one repeating unit structure selected from the group consisting of the general formulas (A) to (G)

A

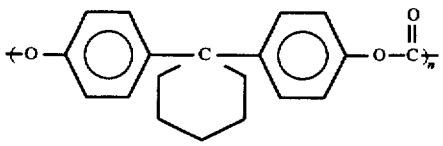

B

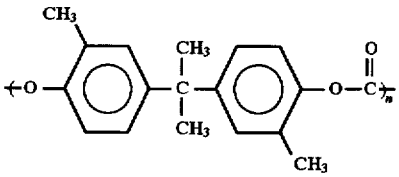

-continued

C

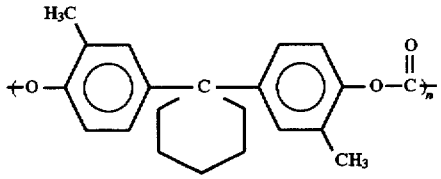

E

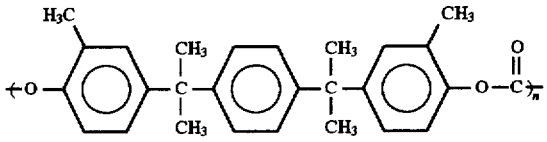

F

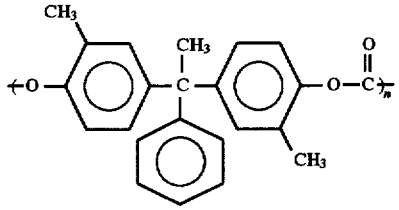

G

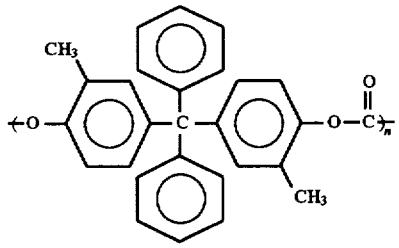

11. The method of claim 9 wherein the photosensitive layer further contains a polycarbonate resin having at least one repeating unit structure selected from the group consisting of the general formulas (A) to (G)

A

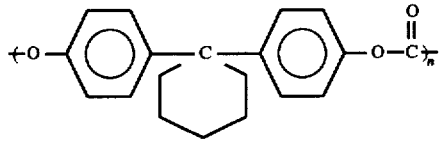

B

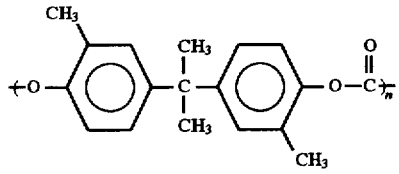

C

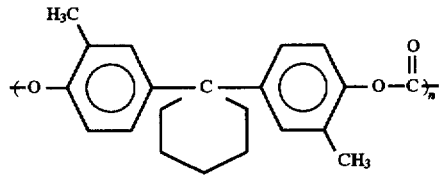

E

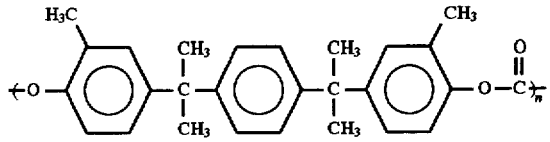

-continued

F

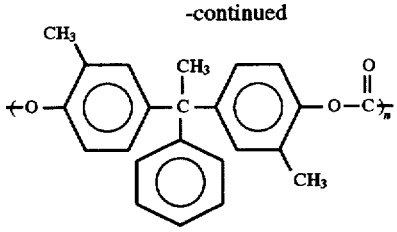

G

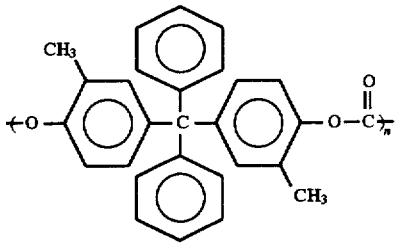

12. The method of claim 1 wherein an under layer is provided between the electroconductive support and the photosensitive layer.

13. A photosensitive body for liquid development that is utilized for forming an electrostatic image in a method for making an image comprising the steps of forming the electrostatic image and forming a visible image by means of the liquid development utilizing a liquid developer for an electrostatic charge latent image, which liquid developer comprises at least toner particles that are made by dispersing a dye or a pigment in a binder resin, an electrically insulating liquid and an electric charge adjusting agent, said photosensitive body comprising as an electric charge transporting material an electric charge transporting polymeric compound that contains as a partial moiety of repeating units at least one of the structures represented by the following general formulas I-1 and I-2, (I-1)

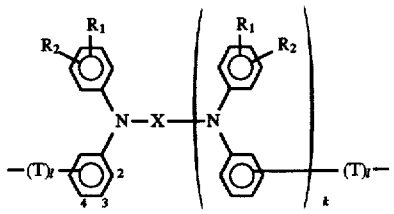

(I-2)

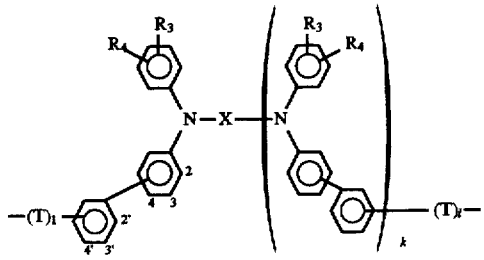

where $R_1$–$R_4$ are each independently selected from the group consisting of hydrogen, an alkyl radical that may have a substituent, an alkoxy radical that may have a substituent, a substituted amino radical, halogen and a substituted or unsubstituted aryl radical, X is a substituted or unsubstituted divalent aryl radical, k and l are each an integer of 0 or 1, and T is a divalent hydrocarbon radical of 1–10 carbon atoms that may be branched.

14. The photosensitive body for liquid development of claim 13 wherein the electric charge transporting polymeric compound has a weight average molecular weight of 5,000–750,000.

15. The photosensitive body for liquid development of claim 13 wherein $R_1$–$R_4$ are each independently hydrogen or an alkyl radical of 1–40 carbon atoms that may have a substituent and X represents as follows:

(1)

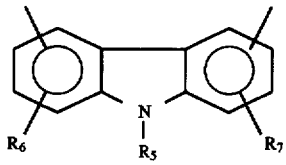

(2)

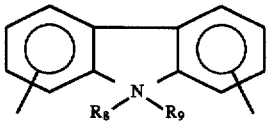

(3)

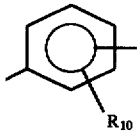

(4)

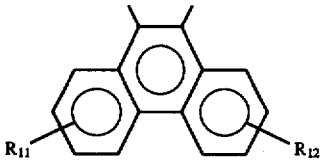

(5)

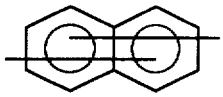

(6)

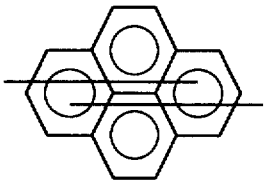

where $R_5$ is selected from the group consisting of hydrogen, an alkyl radical of 1–4 carbon atoms, a substituted or unsubstituted phenyl radical and a substituted or unsubstituted araklyl radical and $R_6$–$R_{12}$ are each independently selected from the group consisting of hydrogen, an alkyl radical of 1–4 carbon atoms, an alkoxy radical of 1–4 carbon atoms, a substituted or unsubstituted phenyl radical, a substituted unsubstituted araklyl radical and halogen.

16. The photosensitive body for liquid development of claim 15 wherein $R_1$–$R_4$ are each independently hydrogen or an alkyl radical of 1–4 carbon atoms that may have a substituent.

17. The photosensitive body for liquid development of claim 13 wherein $R_1$–$R_4$ are each independently an alkyl radical of 1–40 carbon atoms that may have a substituent and X represents as follows:

$$-Ar-(V)_a-Ar- \quad (7)$$

where Ar represents the following group (8), V is selected from the group consisting of the following groups (9) to (18), and a is 0 or 1:

(8)

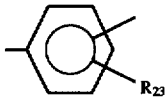

where $R_{23}$ is selected from the group consisting of hydrogen, an alkyl radical of 1–4 carbon atoms, an alkoxy radical off 1–4 carbon atoms, a substituted or unsubstituted phenyl radical, a substituted or unsubstituted araklyl radical and halogen, $$-(CH_2)_b- \quad (9)$$

$$-C(CH_3)_2- \quad (10)$$

$$-O- \quad (11)$$

$$-S- \quad (12)$$

(13)

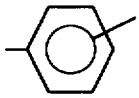

(14)

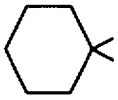

$$-C(CF_3)_2- \quad (15)$$

$$-Si(CF_3)_2- \quad (16)$$

$$-CH=CH- \quad (17)$$

(18)

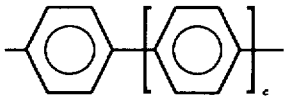

b is an interger of 1–10 and c is an integer of 1–4.

18. The photosensitive body for liquid development claim 17 wherein $R_1$–$R_4$ are each independently hydrogen or an alkyl radical of 1–4 carbon atoms that may have a substituent.

19. The photosensitive body for liquid development of claim 13 wherein the electric charge transporting polymeric compound is selected from the group consisting of the following general formulas (III) to (V):

(III)

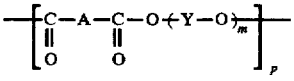

(IV)

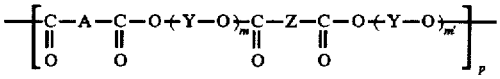

(V)

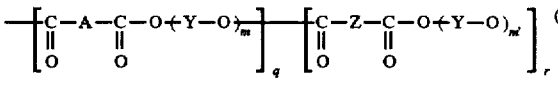

where A represents the structure indicated by the aforementioned general formula (1-1) or (1–2), Y and Z are each a divalent hydrocarbon radical, m and m' are each an integer of 1–5p is an integer of 5–5,000, q is an integer of 5–5,000, r is an integer of 1–3,500 and the sum of q+r is an integer of 5–5,000 with the provision that $1>q/(q+r)\geqq 0.3$.

20. The photosensitive body for liquid development of claim 13 wherein the photosensitive layer contains the electric charge transporting polymeric compound and a polycarbonate resin having at least one repeating structure selected from the group consisting of the following general formulas (A) to (G):

A
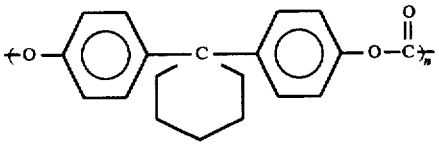
B
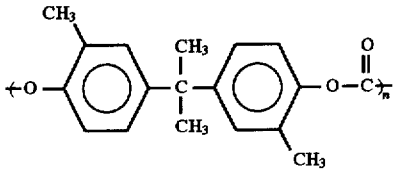
C
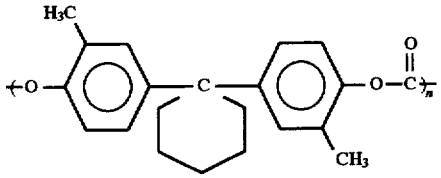
E
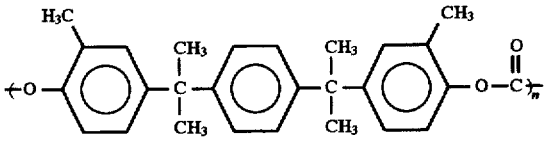
-continued
F
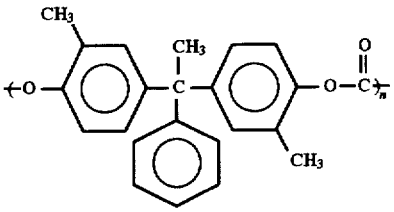
G
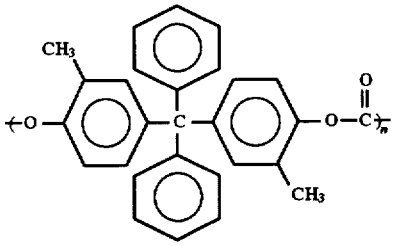
where n takes a value such that the viscosity average molecular weight of the resin is 20,000–100,000.
* * * * *